US011220863B1

(12) United States Patent
Rivera

(10) Patent No.: US 11,220,863 B1
(45) Date of Patent: Jan. 11, 2022

(54) SHOULDER PROTECTOR DEVICE FOR CARRYING A LADDER

(71) Applicant: Teodoro Rivera, Mooresville, NC (US)

(72) Inventor: Teodoro Rivera, Mooresville, NC (US)

(73) Assignee: LADDER CARRY, LLC, Mooresville, NC (US)

( * ) Notice: Subject to any disclaimer, the term of this patent is extended or adjusted under 35 U.S.C. 154(b) by 98 days.

(21) Appl. No.: 15/963,139

(22) Filed: Apr. 26, 2018

(51) Int. Cl.
*E06C 7/00* (2006.01)
*A45F 5/00* (2006.01)

(52) U.S. Cl.
CPC . *E06C 7/00* (2013.01); *A45F 5/00* (2013.01)

(58) Field of Classification Search
CPC ... A45F 3/12; A47B 95/043; A47B 2095/046; B62J 50/10; E06C 7/00
USPC ..... 224/264
See application file for complete search history.

(56) References Cited

U.S. PATENT DOCUMENTS 414,916 A * 11/1889 Nelson ..... A45F 3/12 224/264
834,653 A * 10/1906 Barrett ..... E06C 7/08 182/217
1,952,878 A * 3/1934 Marschutz ..... E06C 7/08 182/194
2,385,171 A * 9/1945 Cowles ..... E06C 7/08 182/217
2,548,215 A 4/1951 Horch
3,523,710 A * 8/1970 Barecki ..... B60N 2/7041 297/216.13
3,662,856 A 5/1972 D'Amico et al.
3,706,173 A * 12/1972 Taylor ..... B60J 10/26 52/717.03
3,993,163 A 11/1976 Barrett
4,129,318 A * 12/1978 Cahill ..... B62J 99/00 224/265

(Continued)

FOREIGN PATENT DOCUMENTS

CA 2 476 584 5/2005

OTHER PUBLICATIONS

Amazon.com: Louisville Ladder FS1110HD Fiberglass Step Ladder, https://www.amazon.com/dp/B000KL2Y6W?ref_=ams_ad_dp_asin_1.

(Continued)

*Primary Examiner* — Colleen M Chavchavadze
(74) *Attorney, Agent, or Firm* — Everman Law Firm, P.A.; Gregory R. Everman

(57) ABSTRACT

A shoulder protector device that is releasably attachable to a ladder. The shoulder protector device includes a body having a first portion, a second portion and a third portion disposed between and integral with the first portion and the second portion. The protector device further includes a first longitudinal portion spanning the longitudinal length of the body and an opposed second longitudinal portion spanning the longitudinal length of the body. The first longitudinal portion includes a slot. The slot has a first section provided in the first portion of the body and a second section provided in the second portion of the body. The first section of the slot is configured to receive an edge of a rung of a ladder and the second section of the slot is configured to receive an edge of a rail of the ladder such that the edge of the rung and the edge of the rail can concurrently be disposed within the first section of the slot and second section of the slot, respectively.

16 Claims, 7 Drawing Sheets

(56) References Cited

U.S. PATENT DOCUMENTS 4,469,194 A 9/1984 McBride
4,474,386 A * 10/1984 Kanemaki ..... B62J 99/00 224/265
4,580,661 A * 4/1986 Thomson, Jr. ..... E06C 7/486 182/107
4,771,862 A 9/1988 Garland
5,058,789 A * 10/1991 Piper ..... B65G 7/12 224/265
5,080,193 A * 1/1992 Woof ..... E06C 1/34 182/116
5,207,364 A * 5/1993 Johnson ..... B65G 7/12 224/264
5,673,768 A 10/1997 Schmitt et al.
6,021,865 A * 2/2000 Thompson ..... E06C 7/085 182/107
6,189,752 B1 * 2/2001 Perry ..... A45F 5/00 224/264
6,729,438 B1 5/2004 Perett
6,786,371 B2 * 9/2004 Horneman ..... A45F 3/12 182/129
6,986,403 B1 1/2006 Rowland et al.
7,789,198 B2 * 9/2010 Myers ..... E06C 7/50 182/129
7,849,963 B1 * 12/2010 D'Agostino ..... A45F 3/14 182/129
8,251,181 B2 8/2012 Schapiro
8,550,422 B1 * 10/2013 Thomas ..... E06C 7/486 108/27
8,616,334 B2 12/2013 Allred et al.
9,961,987 B1 * 5/2018 Harper ..... A45F 3/047
2002/0046904 A1 * 4/2002 Richard ..... E06C 1/39 182/129
2007/0074932 A1 4/2007 Mutscheller
2008/0011547 A1 * 1/2008 Bonitto ..... E06C 7/00 182/129
2009/0211843 A1 8/2009 McClain
2012/0132683 A1 * 5/2012 Middlebrook ..... A45F 3/12 224/265
2014/0027203 A1 * 1/2014 Whitcomb ..... E06C 7/00 182/129
2015/0083521 A1 * 3/2015 Foddrill ..... E06C 7/00 182/129

OTHER PUBLICATIONS

Ver Sales, Inc. 2011 http://www.versales.com/ns/ladders/cotterman/track.html.

* cited by examiner

SHOULDER PROTECTOR DEVICE FOR CARRYING A LADDER

FIELD OF THE INVENTION

This invention relates generally to ladders and more particularly to a shoulder protector device that is removably attachable to a ladder in order to facilitate the carrying of a ladder on a shoulder of a person.

BACKGROUND OF THE INVENTION AND RELATED ART

A-frame ladders and other types of ladders are difficult to carry from place to place because of their weight and length, often six feet or more, make them awkward and cumbersome to handle. Aggravating this problem is the fact that a ladder is often needed in a place that is somewhat difficult to access and/or may need to be carried a fairly long distance to its point of use.

A common way for a person to carry a ladder is by holding the middle of the ladder with one or two hands, depending on its weight, at the side of the person near the hip. In this carrying position, the ladder is oriented horizontally and extends lengthwise several feet forward and rearward of the person. As such, much care is needed when carrying a ladder along a hallway, stairwell, around corners or through a doorway to ensure that the ends of the ladder do not strike and damage walls or other objects. Additionally, a ladder carried this way also tends to bang against the leg of the person carrying the ladder. And, by having the ladder hanging at the side of a person the ladder's weight is greatly off-set from the person's sagittal plane which can lead to back injury. A further difficultly is that sufficient hand strength is required to carry and control a ladder, particularly where the point of use is at a long distance and in spaces that are difficult to navigate such as a stairwell.

In view of these disadvantages, another common technique to carry a ladder is to balance it on the shoulder and to then walk slowly and carefully to the desired location. The ladder may be positioned such that a rail rest on the shoulder, a rung rest on the shoulder, or both a rail and rung simultaneously rest on the shoulder for example when the shoulder is positioned at a rail-rung junction.

Nonetheless, this technique is not wholly satisfactory and can result in physical injuries. A notable problem is that the entire weight of the ladder is concentrated on the shoulder and is borne by the clavicle and/or surrounding tissue. In particular, ridge lines formed by edges of the rail and/or rung concentrate the full weight of the ladder into the shoulder. Consequently, there is not only considerable discomfort to the shoulder area, but there is also a risk of physical injury to the shoulder and neck as well as aggravation of any prior injury to these areas.

To reduce shoulder discomfort, oftentimes a person lifts with their hand to offset a portion of ladder's weight and/or to periodically reposition the ladder on the shoulder. This lifting and repositioning can cause fatigue and potentially injury and does not satisfactorily resolve the problem of shoulder discomfort.

In view of the aforementioned deficiencies, there exists a need for a shoulder protector device that aids a person in carrying a ladder, for example a step ladder, with their shoulder. More particularly, there exists a need for a shoulder protector device to protect and comfort the shoulder of a person from edges of the rail and/or rung while carrying a ladder. There exists a further and more specific need for a shoulder protector device that disperses the weight of a ladder over a greater area of a person's shoulder as compared to not using the device. There also exists a need for a shoulder protector device that is easily attached to a ladder for moving the ladder to a new location and easily removed so that the device will not interfere with use of the ladder. There further also exists a need for a shoulder protector device to be cost-effective and simple to use.

SUMMARY OF THE INVENTION

The present invention is a shoulder protector device that is removably attachable to a ladder in order to facilitate the carrying of a ladder on a shoulder of a person. In an aspect, the invention is embodiment by a shoulder protector device that includes a body having a first portion, a second portion and a third portion disposed between and integral with the first portion and the second portion. The body has a longitudinal axis with a first section defined by the first portion, a second section defined by the second portion and a third section defined by the third portion. The first section of the longitudinal axis and the second section of the longitudinal axis are at an angle relative to each other in a range of 60 degrees to 130 degrees. The body also has opposed first and second longitudinal portions. The first longitudinal portion includes a slot having a first section, a second section and a third section provided in the first portion, the second portion and the third portion of the body, respectively. The first section of the slot is adapted to receive an edge of a rung of a ladder and the second section of the slot is adapted to receive an edge of a rail of the ladder. As such, the shoulder protector device is capable of having the edge of the rung and the edge of the rail being simultaneously disposed within the first section of the slot and the second section of the slot, respectively. In an aspect, the third section of the longitudinal axis is curved and the first section and second section of the longitudinal axis are linear. In another aspect the second longitudinal portion has an outer surface with a first section, a second section and a third section intermediate the first section and the second section. The third section of the second longitudinal portion has a longitudinal length and is concave along its longitudinal length. In yet another aspect, the third section of the second longitudinal portion is curved about the third section of the longitudinal axis. In still another aspect, first section of the slot and second section of the slot has a width of at least 1/16 inch and more preferably have a width in a range of 1/16 inch to 1/4 inch. In another aspect, the first section of the slot and the second section of the slot are at an angle relative to each other in a range of 60 degrees to 130 degrees. In another aspect, the longitudinal axis has an averaged first section defined by the first portion and an averaged second section defined by the second portion and the averaged first section and the averaged second section are at an angle relative to each other in a range of 60 degrees to 130 degrees. In still another aspect, the averaged first section of the longitudinal axis and the first section of the longitudinal axis can coincide, be different from each other, or skewed relative to each other. In a further aspect, at least a portion of the third section of the slot is laterally offset from the first section of the slot and has a width of at least 1/8 inch.

In an aspect, the invention is embodiment by a shoulder protector device that is releasably attachable to a ladder and includes a body having a first portion, a second portion and a third portion disposed between and integral with the first portion and the second portion. The body has a longitudinal axis having a first section defined by the first portion, a second section defined by the second portion and a third section defined by the third portion. The first section of the longitudinal axis and the second section of the longitudinal axis are at an angle relative to each other in a range of 60 degrees to 130 degrees. The body also has a first longitudinal portion and an opposed second longitudinal portion. The first longitudinal portion includes a slot having a first section, a second section and a third section provided in the first portion, the second portion and the third portion of the body, respectively. The shoulder protector device is attachable to an edge of a rung and to an edge of a rail of the ladder in which the edge of the rung and the edge of the rail are at an angle in a range of 90 degrees to 110 degrees relative to each other. Furthermore, the shoulder protector device is capable of having the edge of the rung and the edge of the rail being simultaneously disposed within the first section of the slot and the second section of the slot, respectively. In an aspect, the shoulder protector device is in an interference fit with the ladder when the shoulder protector device is attached to the ladder. In another aspect, each of the first section of the slot and second section of the slot has a width of at least 1/16 inch. In still another aspect, the longitudinal axis has an averaged first section defined by the first portion and an averaged second section defined by the second portion. The averaged first section and the averaged second section are at an angle relative to each other in a range of 60 degrees to 130 degrees.

In an aspect, the invention is embodiment by a method of applying a shoulder protector device to a ladder, including the steps of: providing the shoulder protector device in which the shoulder protector device includes a body having a first portion, a second portion and a third portion disposed between and integral with the first portion and the second portion, in which the body has a longitudinal axis having a first section defined by the first portion, a second section defined by the second portion and a third section defined by the third portion; wherein the first section of the longitudinal axis and the second section of the longitudinal axis are at an angle relative to each other in a range of 60 degrees to 130 degrees; wherein the body has a first longitudinal portion and an opposed second longitudinal portion; wherein the first longitudinal portion includes a slot having a first section, a second section and a third section provided in the first portion, the second portion and the third portion of the body, respectively; and applying the shoulder protector device to the ladder whereby an edge of a rung of the ladder is disposed within the first section of the slot and an edge of a rail of the ladder is disposed within the second section of the slot. In an aspect, the method further includes wherein the edge of the rung and the edge of the rail are at an angle in a range of 90 degrees to 110 degrees relative to each other, wherein the longitudinal axis has an averaged first section defined by the first portion and an averaged second section defined by the second portion, and wherein the averaged first section and the averaged second section are at an angle relative to each other in a range of 60 degrees to 130 degrees.

Other aspects, objects, features and advantages of the invention will be made apparent or will be readily understood and appreciated by those skilled in the related art as the invention is described in greater detail hereinafter and is shown in the accompanying drawing figures. It is envisioned that all such aspects, objects, features and advantages of the invention as shown and described herein will be within the intended broad scope of the appended claims. The above and other aspects, objects, features and advantages may be accomplished by any of the exemplary embodiments of the invention described herein and illustrated in the accompanying drawings. However, it should be appreciated that the drawing figures are for illustrative purposes only, and that many modifications, changes, revisions and substitutions may be made to the exemplary embodiments illustrated herein without departing from the broadest reasonable interpretation of the appended claims.

BRIEF DESCRIPTION OF THE DRAWINGS

The aforementioned objects, features and attendant advantages of the invention will be more fully understood and appreciated when considered in conjunction with the accompanying drawings.

DETAILED DESCRIPTION OF THE EXEMPLARY EMBODIMENTS

Figure 1:
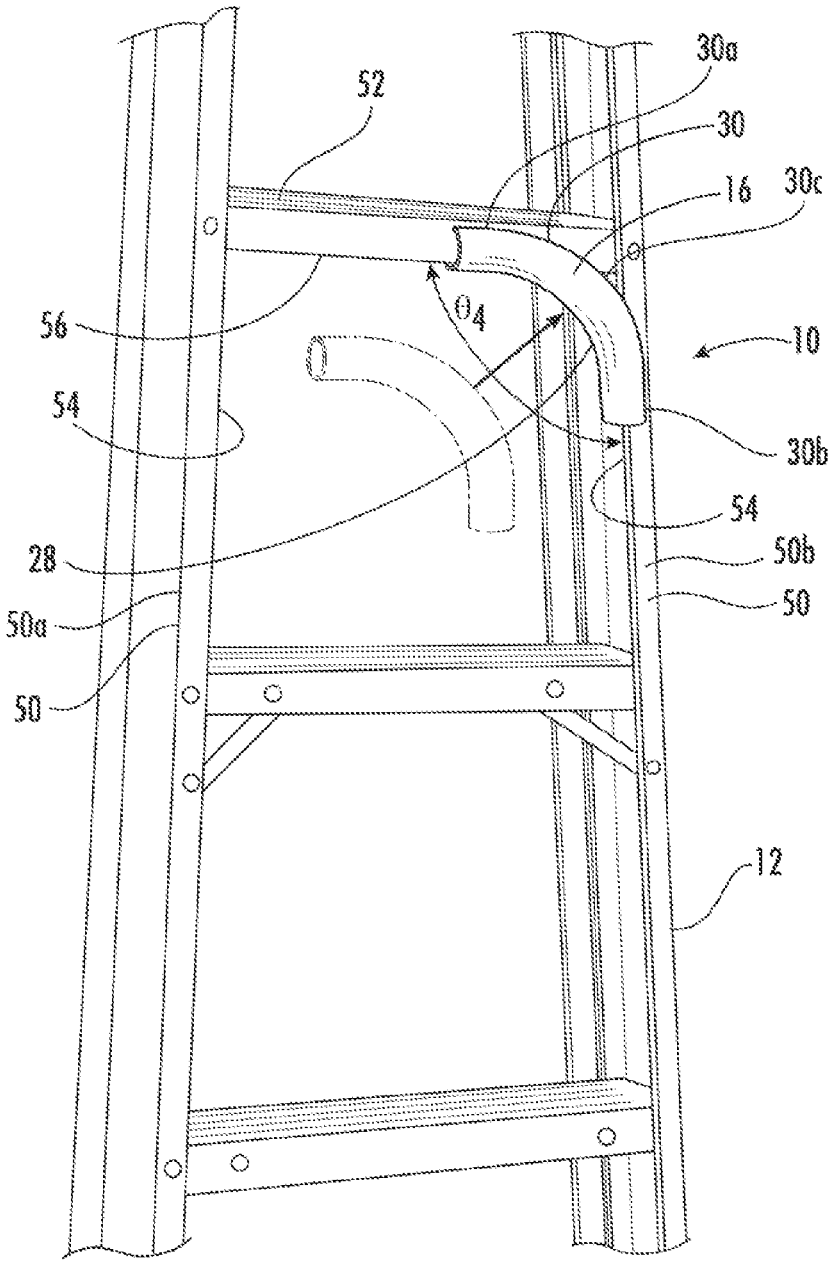
FIG. 1 is an environmental perspective view illustrating a shoulder protector device attached to a ladder according to an exemplary embodiment of the invention.

The present invention will now be described more fully hereinafter with reference to the accompanying drawings in which preferred embodiments of the invention are shown. This invention may, however, be embodied in many different forms and should not be considered as limited to the embodiments set forth herein. These exemplary embodiments are provided so that this disclosure will be both thorough and complete, and will fully convey the scope of the invention to those skilled in the art. Throughout the several views of the drawings, like reference characters designate the same or similar parts.

FIGS. 1-9 illustrate exemplary embodiments of a shoulder protector device, designated generally by reference character 10, according to the invention. In the exemplary embodiments shown and described herein, the shoulder protector device 10 facilitates the carrying of a ladder 12 (see FIGS. 1, 2 and 6) on a shoulder 13 of a person 14 (see FIG. 2 in which the person is in the foreground and the shoulder protector device 10 is on the right shoulder of the person 14).

The shoulder protector device 10 includes a body 16 having a first end portion 18, a second end portion 20, and an intermediate third portion 22 between and integral with the first end portion 18 and the second end portion 20.

The body 16 has a longitudinal axis 24 along its centerline. The longitudinal axis 24 is comprised of three sections 24*a*, 24*b*, 24*c*.

Figure 3:
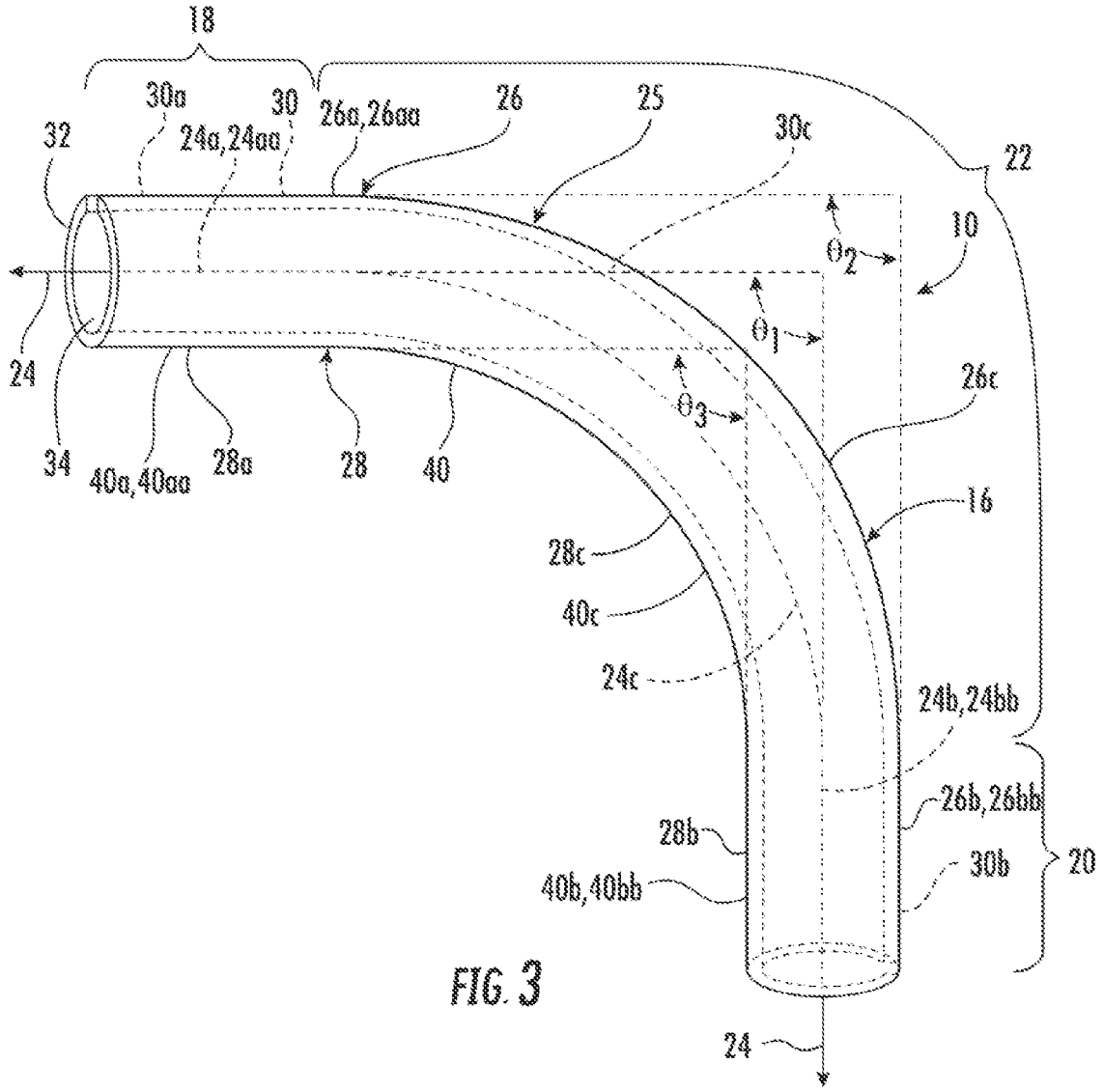
FIG. 3 is a right side perspective view of the shoulder protector device of FIG. 1. The left side of the shoulder protector device is the mirror image of the right side of the protector device.

Referring to FIG. 3, the first section 24*a* is linear and is defined by the first end portion 18 of the body 16, the second section 24*b* is linear and is defined by the second end portion 20 of the body 16, and the third section 24*c* is curved and is defined by the intermediate third portion 22 of the body 16. It is within the scope of this invention that the third section 24*c* may have a shape other than being curved; for example, the third section 24*c* may be linear and angled between the first section 24*a* and second section 24*b*.

Referring to FIG. 3, the first section 24*a* of the longitudinal axis 24 has an averaged first section 24*aa*. As used herein, the averaged first section 24*aa* is a linear line of best fit of the first section 24*a*. Likewise, the second section 24*b* of the longitudinal axis 24 has an averaged second section 24*bb*. As used herein, the averaged second section 24*bb* is a linear line of best fit of the first section 24*b*. In the embodiment illustrated in FIG. 3, the averaged first section 24*aa* and averaged second section 24*bb* are the same as the first section 24*a* and second section 24*b*, respectively. The averaged first section 24*aa* and the averaged second section 24*bb* are at an angle $\theta_1$ relative to each other in a range of 60 degrees to 130 degrees, preferably in a range of 70 degrees to 120 degrees and more preferably in a range of 80 degrees to 110 degrees.

Depending on the shape of the body 16, the first section 24*a* and/or second section 24*b* of the longitudinal axis 24 may not be linear. For example and referring to FIG. 9, in an embodiment in which the first end portion 18 and the second end portion 22 are curved, then the first section 24*a* and second section 24*b* of the longitudinal axis 24 are also curved. As another example, in an embodiment in which the first end portion 18 and the second end portion 22 are saw toothed (not illustrated), then the first section 24*a* and second section 24*b* of the longitudinal axis 24 may be undulating. In embodiments where the first section 24*a* is not linear and/or second section 24*b* is not linear then the averaged first section 24*aa* (i.e. linear line of best fit of the first section 24*a*) and the averaged second section 24*bb* (i.e. linear line of best fit of the second section 24*b*) are at an angle $\theta_1$ relative to each other in a range of 60 degrees to 130 degrees, preferably in a range of 70 degrees to 120 degrees and more preferably in a range of 80 degrees to 110 degrees.

This method of determining the angle $\theta_1$ between the averaged first section 24*aa* (i.e. linear best fit line of the first section 24*a* of the longitudinal axis 24) and the averaged second section 24*bb* (i.e. linear best fit line of the second section 24*b* of the longitudinal axis 24) is not limited to the exemplary embodiments herein. For example, this method is used when the first section 24*a* of the longitudinal axis 24 and/or the second section 24*b* of the longitudinal axis 24 has combination of linear and curved portions, a plurality of linear portions, or a plurality of curved portions.

Figure 4:
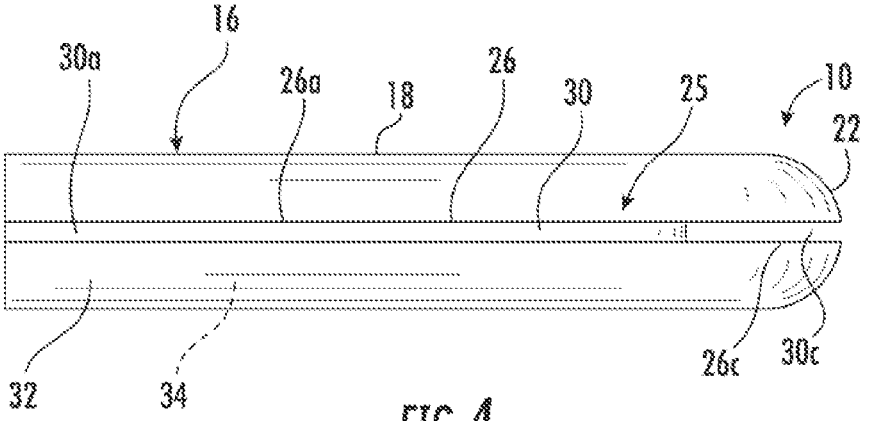
FIG. 4 is a top view of the shoulder protector device of FIG. 4.
Figure 5:
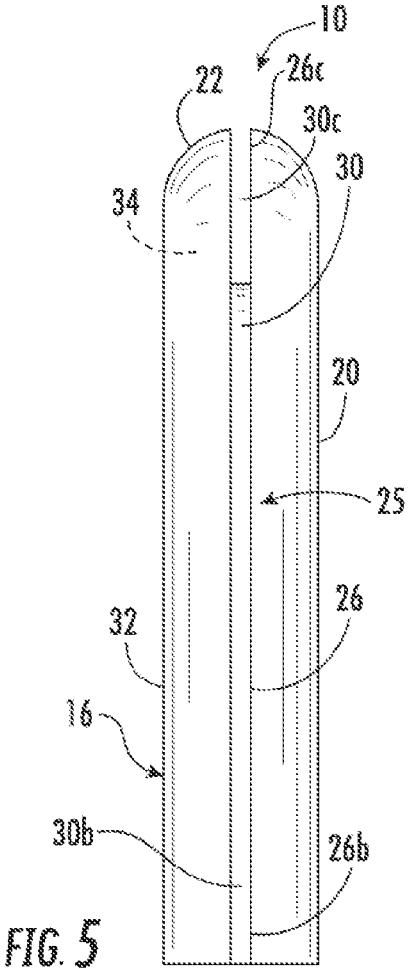
FIG. 5 is a front view of the shoulder protector device of FIG. 4.

Referring to FIGS. 3-5, the body 16 includes a first longitudinal portion 25 and an opposed second longitudinal portion 28. The first longitudinal portion 25 spans the longitudinal length of the body 16 and includes a longitudinal slot 30. The first longitudinal portion 25 has an outer surface 26 comprised of three sections 26*a*, 26*b*, 26*c*. In the longitudinal direction, the first section 26*a* is linear and is a part of the first end portion 18 of the body 16, the second section 26*b* is linear and is a part of the second end portion 20 of the body 16 and the third section 26*c* is curved and is a part of the intermediate third portion 22 of the body 16. It is within the scope of this invention that the third section 26*c* may have a shape other than being curved; for example, the third section 26*c* may be linear and at an angle between the first section 26*a* and second section 26*b*.

The first section 26*a* of the first longitudinal portion 25 has an averaged first section 26*aa*. As used herein, the averaged first section 26*aa* is a linear line of best fit in the longitudinal direction of the first section 26*a*. Likewise, the second section 26*b* of the first longitudinal portion 25 has an averaged second section 26*bb*. As used herein, the averaged second section 26*bb* is a linear line of best fit in the longitudinal direction of the second section 26*b*. In the embodiment illustrated in FIG. 3, the averaged first section 26*aa* and averaged second section 26*bb* are the same as the first section 26*a* and second section 26*b*, respectively. The averaged first section 26*aa* and the averaged second section 26*bb* are at an angle $\theta_2$ relative to each other in a range of 60 degrees to 130 degrees, preferably in a range of 70 degrees to 120 degrees and more preferably in a range of 80 degrees to 110 degrees.

In a preferred embodiment the third section 26*c* has a length of a range of 4 inches to 12 inches, and more preferably in a range of 6 inches to 10 inches, as measured along its outer surface in the longitudinal direction. And, each of the first section 26*a* and the second section 26*b* has a length in the range of ½ inch to 6 inches, and more preferably in a range of 2 inches to 5 inches, as measured along their respective linear line of best fit.

Depending on the shape of the body 16 the first section 26*a* and/or second section 26*b* of the first longitudinal portion 25 may not be linear in the longitudinal direction. For example and referring to FIG. 9, in an embodiment in which the first end portion 18 and the second end portion 22 are curved in the longitudinal direction, then the first section 26*a* and second section 26*b* of the first longitudinal portion 25 are also curved. As another example, in an embodiment in which the first end portion 18 and the second end portion 22 are saw toothed (not illustrated), then the first section 26*a* and second section 26*b* of the first longitudinal portion 25 are saw toothed. In embodiments in which the first section 26*a* is not linear and/or second section 26*b* is not linear then the averaged first section 26*aa* (i.e. linear line of best fit of the first section 26*a*) and the averaged second section 26*bb* (i.e. linear line of best fit of the second section 26*b*), respectively, are at an angle $\theta_2$ relative to each other in a range of 60 degrees to 130 degrees, preferably in a range of 70 degrees to 120 degrees and more preferably in a range of 80 degrees to 110 degrees.

In embodiments in which the first section 26*a* is not linear, then the length of the first section 26*a* is considered to be as measured in a straight line along the averaged first section 26*aa*. Likewise, in embodiments in which the second section 26*b* is not linear, then the length of the second section 26*b* is considered to be as measured in a straight line along the averaged second section 26*bb*. For such embodiments, preferably the third section 26*c* has a length in a range of 4 inches to 12 inches, and more preferably in a range of 6 inches to 10 inches, as measured along its outer surface 26 in the longitudinal direction. And, each of the first section 26*a* and the second section 26*b* has a length in the range of ½ inch to 6 inches, and more preferably in a range of 2 inches to 5 inches, as measured along their respective the linear line of best fit.

Figure 9:
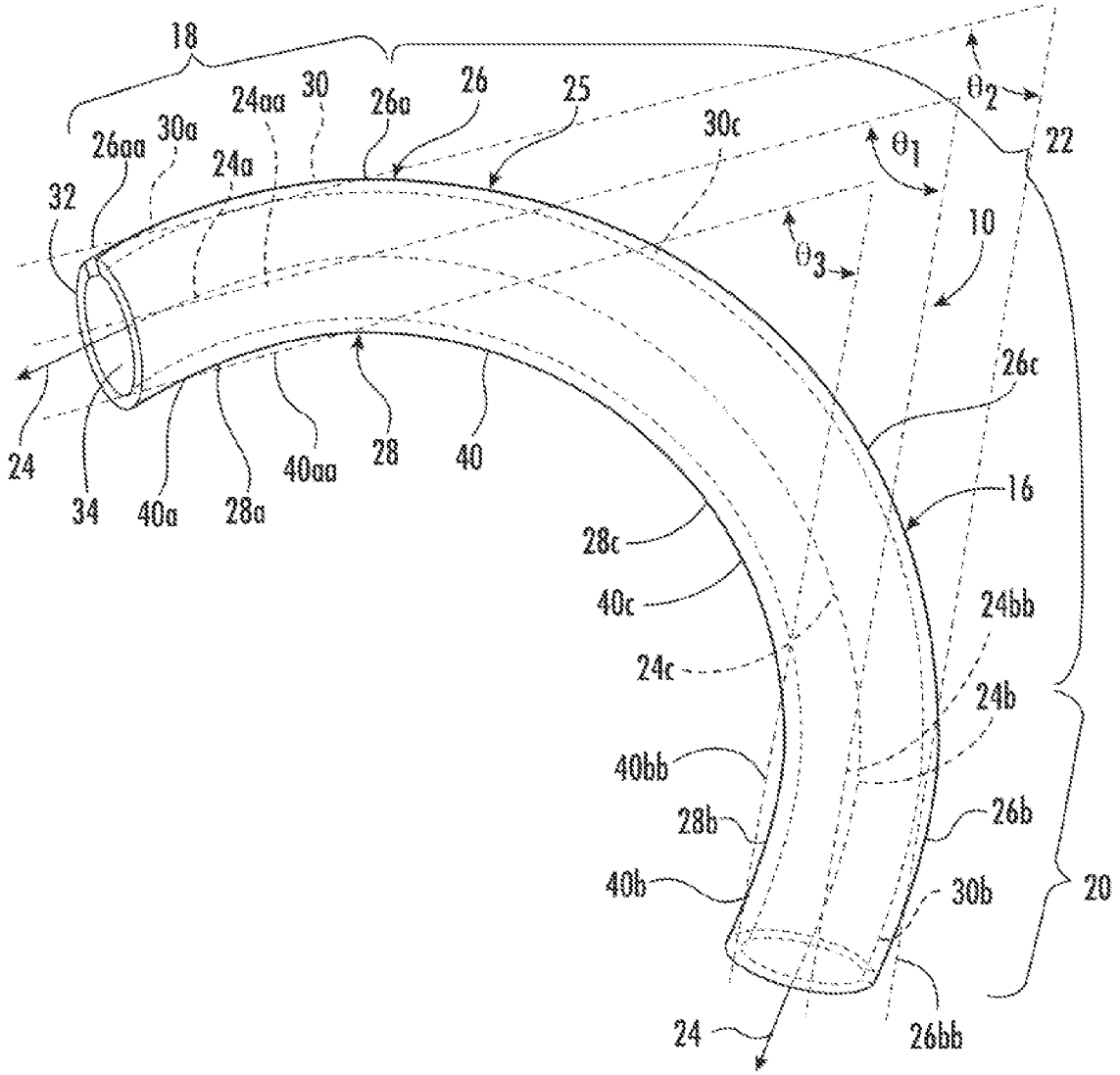
FIG. 9 is a right side perspective view of the shoulder protector device according to an exemplary embodiment of the invention. The left side of the shoulder protector device is the mirror image of the right side of the protector device.

Referring to FIGS. 3 and 9, the slot 30 extends for at least a portion of the longitudinal length of the body 16 and preferably extends the full longitudinal length of the body 16. The slot 30 is comprised of three sections 30*a*, 30*b*, 30*c*. For purposes of the present invention, the first section 30*a*, second section 30*b*, and third section 30*c* of the slot 30 are considered to be the same as the first section 26*a*, second section 26*b* and third section 26*c*, respectively, of the first longitudinal portion 26 with regards to whether the slot sections 30*a*, 30*b*, 30*c* are linear, curved or a combination of being linear and curved in the longitudinal direction and also with regards to an angle $\theta_2$ that the first section 30*a* and second section 30*b* of the slot 30 are relative to each other. As such and referring to FIG. 3, in the longitudinal direction the first section 30*a* is linear and is provided in the first end portion 18 of the body 16, the second section 30*b* is linear and is provided in the second end portion 20 of the body 16, and the third section 30*c* is curved and is provided in the intermediate third portion 22 of the body 16. In the longitudinal direction, the first section 30*a* and the second section 30*b* are at an angle $\theta_2$ relative to each other in a range of 60 degrees to 130 degrees, preferably in a range of 70 degrees to 120 degrees and more preferably in a range of 80 degrees to 110 degrees.

Depending on the shape of the body 16 the first section 30*a* and/or second section 30*b* of the slot 30 may not be linear in the longitudinal direction. For example and referring to FIG. 9, in an embodiment in which the first end portion 18 and the second end portion 22 are curved in the longitudinal direction, then the first section 30*a* and second section 30*b* of the slot 30 are also curved. As another example, in an embodiment in which the first end portion 18 and the second end portion 22 are saw toothed (not illustrated), then the first section 30*a* and second section 30*b* of the slot 30 are saw toothed. In an embodiment in which the first section 30*a* is not linear and/or second section 30*b* is not linear then the first section 30*a* is considered to be the same as the averaged first section 26*aa* (i.e. linear line of best fit of the first section 26*a*) and the averaged second section 26*bb* (i.e. linear line of best fit of the second section 26*b*), respectively, of the outer surface 26 of the first longitudinal portion 25, which as previously described herein are at an angle $\theta_2$ relative to each other in a range of 60 degrees to 130 degrees, preferably in a range of 70 degrees to 120 degrees and more preferably in a range of 80 degrees to 110 degrees.

Referring to FIGS. 3 and 9, the slot 30 has a depth of at least ⅛ inch and more preferably has a depth at least ¼ inch into the body 16, and has a width of at least 1/16 inch with a preferred width in a range of 1/16 inch to ¼ inch. In the preferred embodiment the body 16 is tubular and has an exterior wall 32 that defines a hollow interior 34. Where the slot 30 extends through the exterior wall 32 and into the hollow interior 36, the depth of the slot 30 is considered to include the hollow interior 34. It is contemplated and within the scope of the invention that the body 16 may not have a hollow interior 34.

In the preferred embodiment the slot 30 is continuous. Notwithstanding, it is contemplated and within the scope of the invention that the slot 30 may be discontinuous, such as for example at a mid-section of the intermediate third portion 22 of the body 16. It is further contemplated and within the scope of the invention that the slot 30 may be discontinuous at the first portion 18 and/or second portion 20. For example, where the first portion 18 and/or second portion 20 has extensive curvature, or configured in saw tooth form with large amplitude, then the slot 30 may need only to be provided in a portion of the first portion 18 and second portion 20 in order to have sufficient depth to releasably attach the shoulder protector device 10 to a ladder 12.

Referring to FIG. 3, the second longitudinal portion 28 includes an outer surface 40 that spans the longitudinal length of the body 16. The outer surface 40 is comprised of three sections 40*a*, 40*b*, 40*c*. In the longitudinal direction, the first section 40*a* is linear at the first end portion 18 of the body 16, the second section 40*b* is linear at the second end portion 20 of the body 16 and the third section 40*c* is curved at the intermediate third portion 22 of the body 16. It is within the scope of this invention that the third section 40*c* may have a shape other than being curved; for example, the third section 40*c* may be linear, angled between the first section 40*a* and second section 40*b*.

Referring to FIG. 3, in the preferred embodiment the first section 40*a* and the second section 40*b* are at an angle $\theta_3$ relative to each other in a range of 60 degrees to 130 degrees, preferably in a range of 70 degrees to 120 degrees and more preferably in a range of 80 degrees to 110 degrees.

The first section 40*a* of the second longitudinal portion 28 has an averaged first section 40*aa*. As used herein, the averaged first section 40*aa* is a linear line of best fit in the longitudinal direction of the first section 40*a*. Likewise, the second section 40*b* of the second longitudinal portion 28 has an averaged second section 40*bb*. As used herein, the averaged second section 40*bb* is a linear line of best fit in the longitudinal direction of the second section 40*b*. In the embodiment illustrated in FIG. 3, the averaged first section 40*aa* and averaged second section 40*bb* are the same as the first section 40*a* and second section 40*b*, respectively. The averaged first section 40*aa* and the averaged second section 40*bb* are at an angle $\theta_3$ relative to each other in a range of 60 degrees to 130 degrees, preferably in a range of 70 degrees to 120 degrees and more preferably in a range of 80 degrees to 110 degrees.

Depending on the shape of the body 16 the first section 40*a* and/or second section 40*b* of the outer surface 40 of the second longitudinal portion 28 may not be linear in the longitudinal direction. For example and referring to FIG. 9, in an embodiment where the first end portion 18 and the second end portion 20 are curved in the longitudinal direction, then the first section 40*a* and second section 40*b* of the outer surface 40 are also curved. The angle $\theta_3$ that the first section 40*a* and second section 40*b* are relative to each other is measured between a linear best fit line of the first section 40*a* of the outer surface 40 of the second longitudinal portion 28 and a linear best fit line of the second section 40*b* of the outer surface 40 of the second longitudinal portion 28. As determined in this manner, the angle $\theta_3$ is in a range of 70 degrees to 120 degrees and more preferably in a range of 80 degrees to 110 degrees.

Referring to FIGS. 3 and 9, preferably the third section 40*c* of the outer surface 40 of the second longitudinal portion 28 has a length of a range of 3½ inches to 11 inches, and more preferably in a range of 5 inches to 9 inches. And preferably, each of the first section 40*a* and the second section 40*b* of the outer surface 40 of the second longitudinal portion 28 has a length in the range of ½ inch to 6 inches, and more preferably in a range of 2 inches to 5 inches, as measured along their respective the linear line of best fit.

Figure 6:
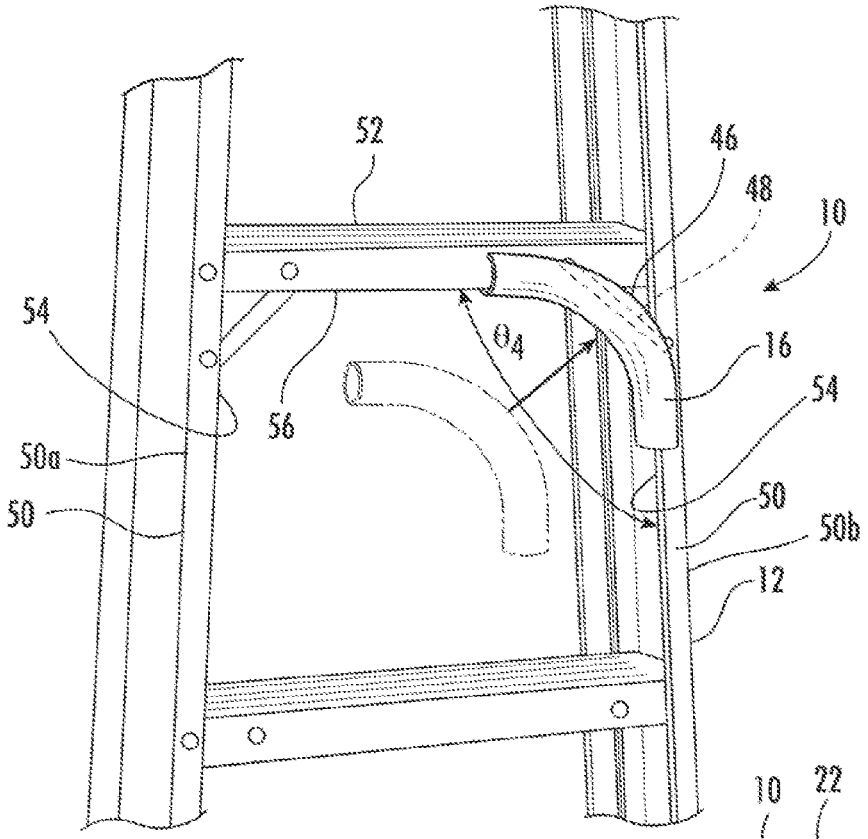
FIG. 6 is an environmental perspective view illustrating a shoulder protector device attached to a ladder according to an exemplary embodiment of the invention.
Figure 7:
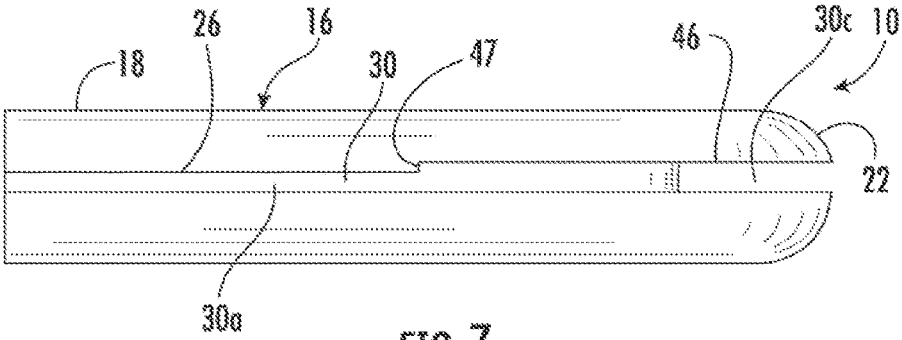
FIG. 7 is a top view of the shoulder protector device of FIG. 6.
Figure 8:
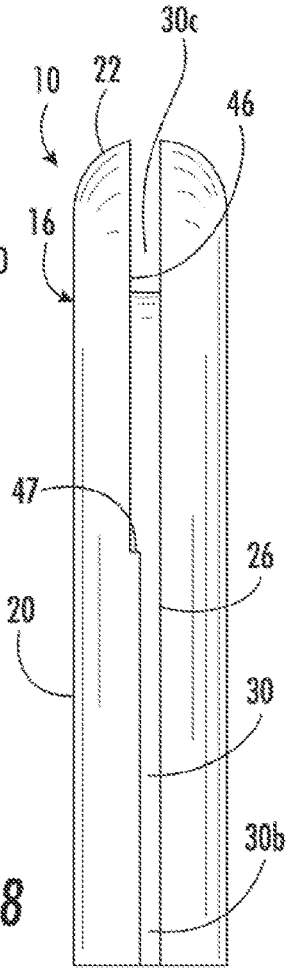
FIG. 8 is a front view of the shoulder protector device of FIG. 7.

Referring to FIGS. 6-8, an exemplary embodiment of the shoulder protector device 10 is illustrated. This embodiment is the same are described herein with regards to FIGS. 1-5 and FIG. 9, except that at least a portion 46 the third section 30*c* of the slot 30 is laterally offset from the first and second sections 30*a*, 30*b* of the slot 30. Preferably, the offset portion 46 has a width 47 of at least 1/16 inch, more preferably at least ⅛ inch and most preferably at least ¼ inch to accommodate a greater variety of ladders. The offset portion 46 accommodates a structural bracket 48 that is provided between a rail 50 and rung 52 on some ladders 12.

The shoulder protector device 10 is preferably tubular with an exterior surface curved around the longitudinal axis 30 and thusly forming a convex outer surface in order to avoid having ridge lines which could otherwise engage against a person's shoulder 13 or neck while using the device 10 to carrying a ladder 12. And, in the longitudinal direction the third section 28*c* of the second longitudinal portion 28 is concave which improves comfort of the device 10 and assists in maintaining the device 10 in position on the shoulder 13 of a person 14. Optionally, padding (not illustrated) may be provided on the second longitudinal portion 28 to further comfort and protect the shoulder 13 of a person using the device 10 while carrying a ladder 12.

The shoulder protector device 10 is made of a durable rigid or semi-rigid material such as plastic, rubber, polyvinyl chloride (PVC) or similarly suitable material.

Figure 2:
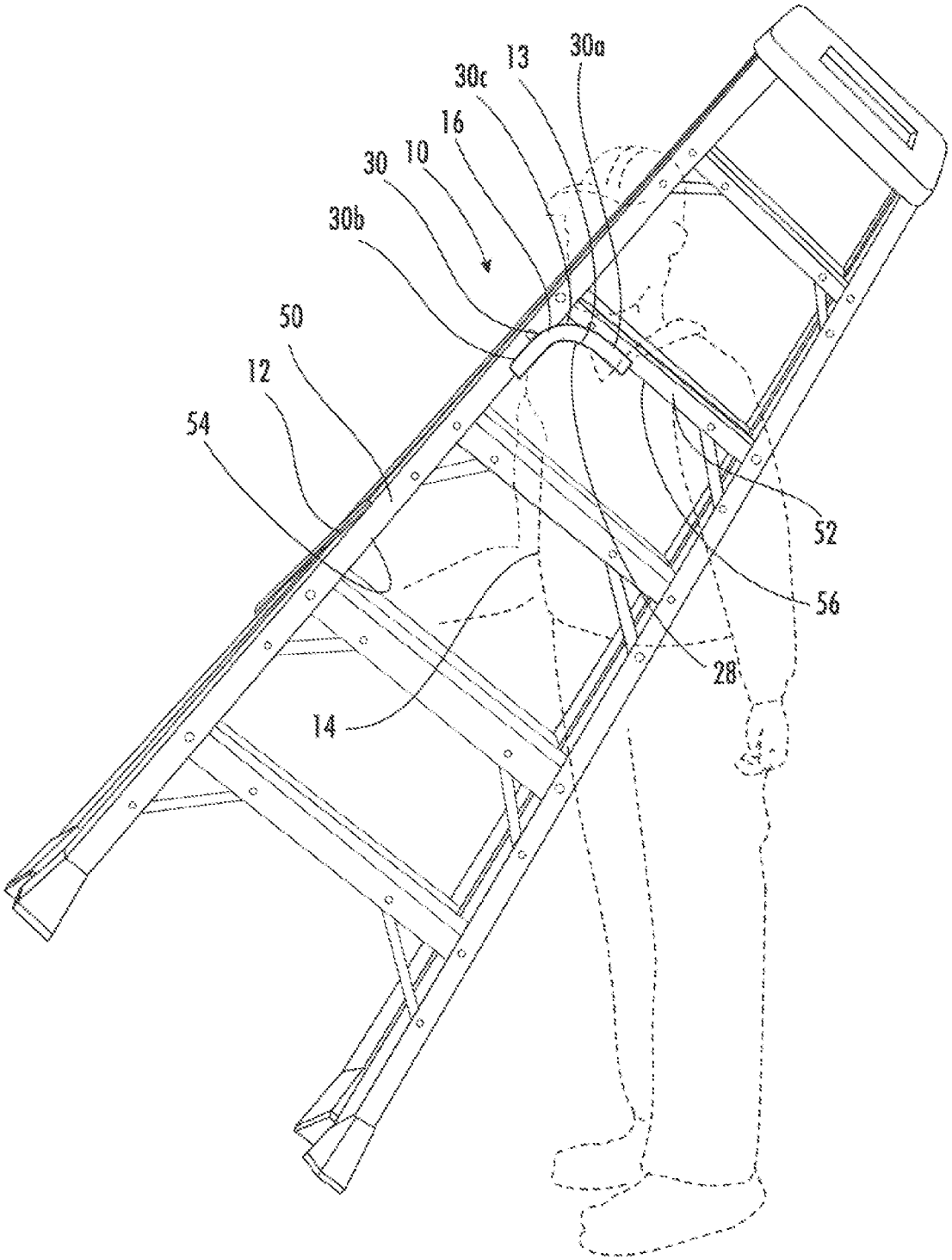
FIGS. 2 and 2A are environmental perspective views illustrating the shoulder protector device attached to a ladder and being used by a person in carrying the ladder according to an exemplary embodiment of the invention.
Figure 2A:
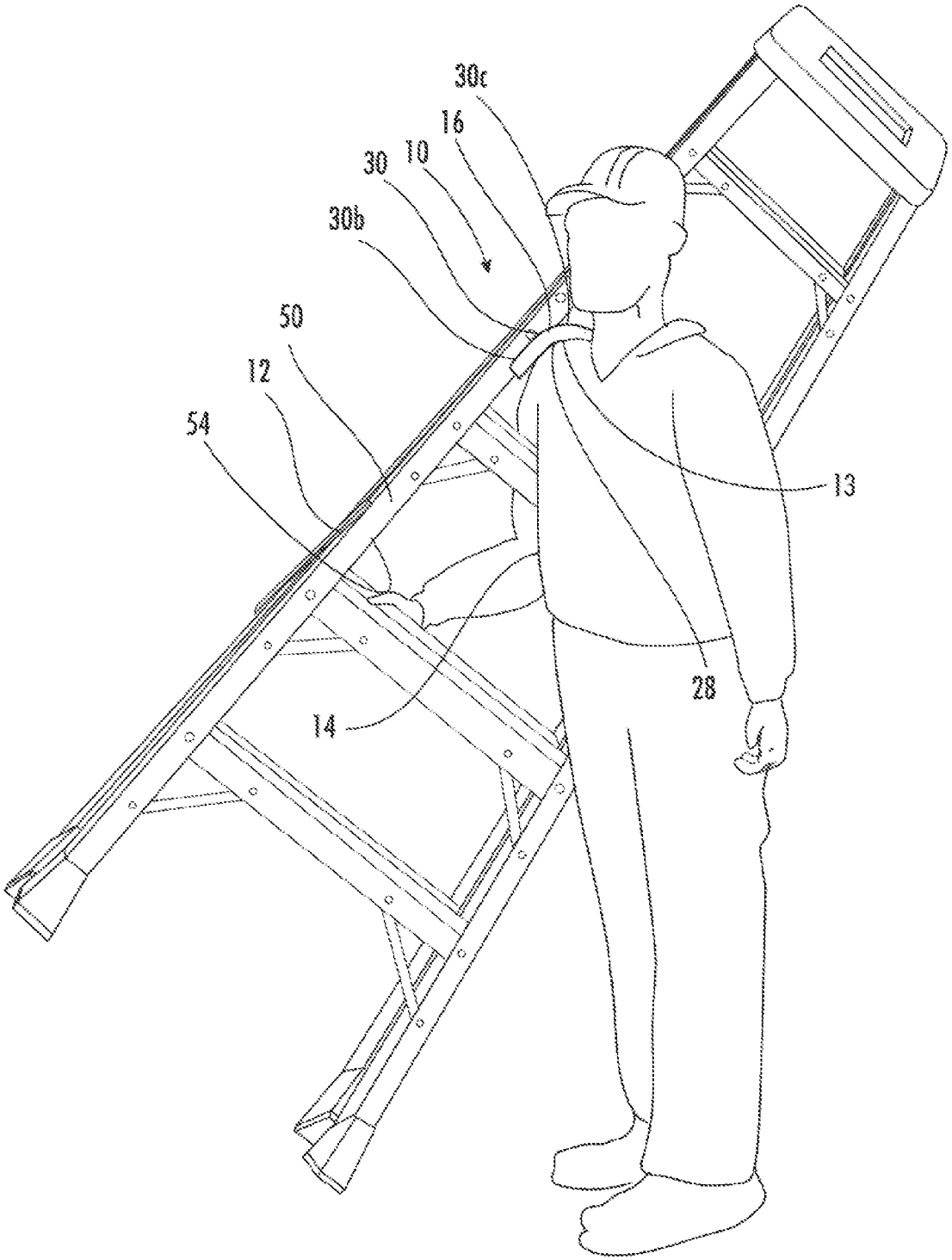

In use, the shoulder protector device 10 is applied to an inwardly directed edge 54 of a rail 50 (for example left rail 50*a* as illustrated in FIGS. 1 and 6 or right rail 50*b* as illustrated in FIGS. 2 and 3) and also to a downwardly directed edge 56 of a rung 52 of a ladder 12. The edges 54, 56 are typically at an angle $\theta_4$ relative to each other in the range of 90 degrees to 110 degrees and the shoulder protector device 10 is configured to receive these edges 54, 56 in the slot 30. In particular, the first section 30*a* of the slot 30 receives a portion of the edge 56 of the rung 52 and the second section 30*b* of the slot 30 receives a portion of the edge 54 of the rail 50. The intermediate third portion 30*c* of the slot 30 may also receive a portion of the edge 56 of the rung 52 and/or edge 54 of the rail 50. As such, a portion of the edge 56 of the rung 52 and edge 54 of the rail 50 are simultaneously positioned within the slot 30. Preferably, edges 54, 56 of the ladder 12 are engaged within the slot 30 in an interference fit thereby keeping the shoulder protector device 10 from freely disengaging from the ladder 12. The interference fit may be caused by, for example and without limitation: i) the slot 30 having a width narrower than the edges 54, 56 of the ladder 12 and wherein the protector device 10 resiliently accommodates insertion of the edges 54, 56 therein, ii) the slot 30 having a width corresponding to the width of the edges 54, 56 whereby the edges 54, 56 can be disposed therein in tight relationship, or iii) the first longitudinal portion 28 having a resilient layer made of rubber, foam or other suitable material on its inward facing wall(s) which accommodates insertion of the edges 54, 56 into the slot 30 and holds the protective device 10 in place onto the ladder 12. The interference fit is easily overcome by a person 14 in order to put the shoulder protector device 10 on, or remove the shoulder protector device 10 from, the ladder 12. Optionally, the protector device 10 may receive edges 54, 56 of the ladder 12 without being in an interference fit such that the device 10 slides into use position where it is held in place during use by a person's shoulder 13. The shoulder protector device 10 may be selectively applied to an edge 56 of the rung 52 and either edge 54 of the right rail 50*a* or left rail 50*b* so that a person 14 may use the device 10 carry the ladder 12 with either the left or right shoulder 13.

Regardless of the foregoing detailed description of exemplary embodiments of the invention, the optimum dimensional relationships for the individual components of the invention, including variations in size, shape, thickness, form, materials, function and manner of operation, assembly and use, as well as equivalents thereof, are deemed to be readily apparent and understood by those skilled in the art. Accordingly, equivalent relationships to those shown in the accompanying drawing figures and described in the written description are intended to be encompassed by the invention, the foregoing being considered as illustrative only of the general concept and principles of the invention. Furthermore, since numerous modifications and changes will readily occur to those skilled in the art, the exemplary embodiments disclosed herein are not intended to limit the invention to the specific configuration, construction, materials and operation shown and described. Instead, all reasonably predictable and suitable equivalents and obvious modifications to the invention should be construed as falling within the scope of the invention as defined by the appended claims given their broadest reasonable interpretation in view of the accompanying written description and drawings.

That which is claimed is:

1. A shoulder protector device, releasably attachable to a ladder, comprising:

a body having a first portion, a second portion and a third portion disposed between and integral with the first portion and the second portion;

wherein the body has a longitudinal axis having a first section defined by the first portion, a second section defined by the second portion and a third section defined by the third portion;

wherein the first section of the longitudinal axis and the second section of the longitudinal axis are at an angle relative to each other in a range of 60 degrees to 130 degrees;

wherein the body has a first longitudinal portion and a second longitudinal portion;

wherein the first longitudinal portion includes a slot having a first section, a second section and a third section provided in the first portion, the second portion and the third portion of the body, respectively, wherein the first section of the slot is adapted to receive an edge of a rung of a ladder and the second section of the slot is adapted to receive an edge of a rail of the ladder;

whereby the shoulder protector device is capable of having the edge of the rung and the edge of the rail being simultaneously disposed within the first section of the slot and the second section of the slot, respectively; and wherein at least a portion of the third section of the slot has a width greater than the width of the first section of the slot.

2. The shoulder protector device in accordance with claim 1, wherein the third section of the longitudinal axis is curved.

3. The shoulder protector device in accordance with claim 2, wherein the first section and second section of the longitudinal axis are linear.

4. The shoulder protector device in accordance with claim 1, wherein the second longitudinal portion has an outer surface comprised of a first section, a second section and a third section intermediate the first section and the second section, wherein the third section of the second longitudinal portion has a longitudinal length and is concave along its longitudinal length.

5. The shoulder protector device in accordance with claim 4, wherein the third section of the second longitudinal portion is curved about the third section of the longitudinal axis.

6. The shoulder protector device in accordance with claim 1, wherein each of the first section of the slot and second section of the slot has a width of at least 1/16 inch.

7. The shoulder protector device in accordance with claim 1, wherein each of the first section of the slot and second section of the slot has a width in a range of 1/16 inch to 1/4 inch.

8. The shoulder protector device in accordance with claim 1, wherein the first section of the slot and the second section of the slot are at an angle relative to each other in a range of 60 degrees to 130 degrees.

9. The shoulder protector device in accordance with claim 1, wherein the longitudinal axis has an averaged first section defined by a linear line of best fit of the first section of the longitudinal axis and an averaged second section defined by a linear line of best fit of the second section of the longitudinal axis, wherein the averaged first section and the averaged second section, are at an angle relative to each other in a range of 60 degrees to 130 degrees.

10. The shoulder protector device in accordance with claim 9, wherein the averaged first section of the longitudinal axis and the first section of the longitudinal axis coincide.

11. The shoulder protector device in accordance with claim 9, wherein the averaged first section of the longitudinal axis and the first section of the longitudinal axis do not coincide.

12. The shoulder protector device in accordance with claim 9, wherein the averaged first section of the longitudinal axis and the first section of the longitudinal axis are skewed relative to each other.

13. A shoulder protector device, comprising:

a body having a first portion, a second portion and a third portion disposed between and integral with the first portion and the second portion;

wherein the body has a longitudinal axis having a first section defined by the first portion, a second section defined by the second portion and a third section defined by the third portion;

wherein the first section of the longitudinal axis and the second section of the longitudinal axis are at an angle relative to each other in a range of 60 degrees to 130 degrees;

wherein the body has a first longitudinal portion and a second longitudinal portion;

wherein the first longitudinal portion includes a slot having a first section, a second section and a third section provided in the first portion, the second portion and the third portion of the body, respectively, wherein the first section of the slit is adapted to receive an edge of a rung of a ladder and the second section of the slot is adapted to receive an edge of a rail of the ladder;

whereby the shoulder protector device is capable of having the edge of the rung and the edge of the rail being simultaneously disposed within the first section of the slot and the second section of the slot, respectively;

wherein at least a portion of the third section of the slot is laterally offset from the first section of the slot; and wherein at least a portion of the third section of the slot has a width greater than the width of the first section of the slot.

14. The shoulder protector device in accordance with claim 13, wherein the at least a portion of the third section of the slot has a width of at least 1/8 inch.

15. The shoulder protector device in accordance with claim 13, wherein the shoulder protector device is capable of being releasable attached to the ladder via an interference fit with the ruing and the rail of the ladder.

16. The shoulder protector device in accordance with claim 13, wherein the at least a portion of the third section of the slot is laterally offset from the second section of the slot.

* * * * *